US008180551B2

(12) United States Patent
Kuwahara et al.

(10) Patent No.: US 8,180,551 B2
(45) Date of Patent: May 15, 2012

(54) VEHICULAR CONTROL APPARATUS AND METHOD

(75) Inventors: Seiji Kuwahara, Toyota (JP); Masato Kaigawa, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 878 days.

(21) Appl. No.: 12/160,689

(22) PCT Filed: Jan. 8, 2007

(86) PCT No.: PCT/IB2007/000074

§ 371 (c)(1),
(2), (4) Date: Jul. 11, 2008

(87) PCT Pub. No.: WO2007/080501

PCT Pub. Date: Jul. 19, 2007

(65) Prior Publication Data

US 2010/0161198 A1 Jun. 24, 2010

(30) Foreign Application Priority Data

Jan. 13, 2006 (JP) ..... 2006-006016

(51) Int. Cl.
*F02D 29/02* (2006.01)
*F02D 41/08* (2006.01)

(52) U.S. Cl. ..... 701/102; 123/339.14

(58) Field of Classification Search ..... 123/339.1, 123/339.14; 701/102

See application file for complete search history.

(56) References Cited

U.S. PATENT DOCUMENTS

| | | | | |
|---|---|---|---|---|
| 5,036,812 | A | 8/1991 | Fukui et al. | |
| 6,948,477 | B2 * | 9/2005 | Tsuyuguchi | 123/339.19 |
| 7,627,407 | B2 * | 12/2009 | Hirooka | 123/333 |
| 2002/0062815 | A1 * | 5/2002 | Kim | 123/339.16 |
| 2004/0254045 | A1 * | 12/2004 | McGee et al. | 477/3 |
| 2005/0092291 | A1 | 5/2005 | Tsuyuguchi | |
| 2006/0089234 | A1 * | 4/2006 | Ogawa | 477/107 |
| 2009/0265076 | A1 * | 10/2009 | Hirose | 701/103 |

FOREIGN PATENT DOCUMENTS

| | | | |
|---|---|---|---|
| EP | 1 450 039 | A1 | 8/2004 |
| JP | 09-068169 | A | 3/1997 |
| JP | 2005-178626 | A | 7/2005 |

OTHER PUBLICATIONS

Japanese Office Action for counterpart Application No. JP 2006-006016, dated Jul. 15, 2008.

* cited by examiner

*Primary Examiner* — Stephen K Cronin
*Assistant Examiner* — Arnold Castro
(74) *Attorney, Agent, or Firm* — Sughrue Mion, PLLC

(57) ABSTRACT

A vehicular control apparatus that controls an engine mounted on a vehicle includes: a generating section that generates respective required values of the engine based on quantities of state in different units of measure; an adjusting section that converts the required values into values in a common unit of measure and obtains a desired value of the engine based on the values in the common unit of measure; a control section that controls the engine based on the obtained desired value; and a determining section that determines whether the vehicle is in an idling state using respective reference values set for the quantities of state, the required values, and the desired value. One of the reference values is converted into the remaining reference values in different units of measure.

7 Claims, 3 Drawing Sheets

FIG. 2

| | C1 | C2 | C3 | C4 | B1 | B2 | B3 | B4 | F0 | F1 | F2 | F3 |
|---|---|---|---|---|---|---|---|---|---|---|---|---|
| P | | | | | | | | | | | | |
| R | | | ○ | | ◎ | | | ○ | | ○ | | |
| N | | | | | | | | | | | | |
| 1st | ○ | | | ◎ | | | | ◎ | ○ | | | ○ |
| 2nd | ○ | | | ◎ | | ◎ | ○ | | ○ | ○ | ○ | |
| 3rd | ○ | | ○ | ◎ | ◎ | | △ | | ○ | ○ | | |
| 4th | ○ | ○ | △ | ◎ | | | △ | | ○ | | | |
| 5th | △ | ○ | ○ | | ○ | | △ | | | | | |
| 6th | △ | ○ | | | △ | ○ | △ | | | | | |

○ENGAGED ◎ENGAGED WHEN ENGINE BRAKING IS USED
△ENGAGED BUT NO INFLUENCE ON POWER TRANSMISSION

VEHICULAR CONTROL APPARATUS AND METHOD

BACKGROUND OF THE INVENTION

1. Field of the Invention

The present invention relates to a vehicular control apparatus and method for controlling a vehicle that is provided with a power train of which driving force control is performed in which various physical quantities are used to perform the control. The present invention particularly relates to a vehicular control apparatus and method that make it possible to accurately and properly determine whether the vehicle is in an idling state.

2. Description of the Related Art

In the vehicle that is provided with an automatic transmission and an engine that can control the engine output torque independently of the accelerator pedal operation by the driver, there is a technical concept in which desired positive or negative driving torque is realized using the engine torque and the gear ratio of the automatic transmission. The desired positive or negative driving torque is calculated based on the depression amount of the accelerator pedal operated by the driver and the operational condition of the vehicle, etc. This concept is referred to as the "driving force control". The control methods such as "driving force request type", "driving force demand type", and "torque demand type" controls are also other types of the driving force control.

The torque demand type control apparatus of the engine calculates the desired torque of the engine based on the depression amount of the accelerator pedal, the engine speed, and the external loads, and controls the fuel injection amount and the air supply amount according to the calculated, desired torque.

In actual operation, the torque demand type control apparatus of the engine as described above calculates the desired torque production by adding the torque loss, such as friction torque, that is the loss caused in the engine and the power train, to the required output torque, and controls the fuel injection amount and the air supply amount so as to actually produce the desired torque.

According to the torque demand type control apparatus of the engine, the engine torque, which is the physical quantity that directly influences the control of the vehicle, is set as a reference value for controlling the vehicle, so that the drivability can be improved, e.g., the steering feel can be always constant.

Japanese Patent Application Publication No. 2005-178626 (JP-A-2005-178626) discloses the integrated control system for a vehicle that improves the failsafe characteristics in the torque demand type control apparatus of the engine described above. The integrated control system for a vehicle includes: a plurality of control units that control the traveling state of the vehicle based on the request made by operation; and a processing unit that generates information used by each of the control units when there is a request for inhibiting operation of the vehicle in accordance with the location information of the vehicle, and outputs the generated information to each of the control units. Each control unit includes: a detection means for detecting a request for operating at least one of the control units; and a calculating means for calculating information regarding the desired control value to operate the actuator provided for each control unit using at least either of information generated by the processing unit or the operational request detected by the detection means.

According to the integrated control system for a vehicle, the drive system, the brake system, and the steering system are integrated to control the vehicle. For example, the integrated control system adjusts a difference between the required driving force that is calculated based on the operation amount of the accelerator pedal operated by the driver and the required driving force calculated by the driving support system, and then calculates command values to be sent to the actuators that control the output torque of the driving power source and the gear ratio of the transmission.

However, when it is determined that the vehicle is in an idling state based on a request for deceleration made by the driver, etc., the fuel-cut control, the deceleration slip control, the neutral control, and the brake control are performed. Conventionally, in many cases, whether the vehicle is in an idling state is determined based on the throttle opening degree using steps such as prediction of the idling state or estimation of a driver's intention, etc.

In the driving force control, a plurality of physical quantities are used to perform control, and therefore, the determination as to whether the vehicle is in an idling state that is made based on each physical quantity becomes important in controlling vehicles. However, because different physical quantities result in different idling state determination results (that is, it is impossible to determine whether the vehicle is in an idling state using the throttle opening degree only as in the conventional manner), it may be possibly determined that the vehicle is not in an idling state although the throttle opening degree is equal to or below a predetermined opening degree which indicates that the vehicle is in an idling state. Specifically, in the driving force control in which differences among a plurality of the physical quantities are adjusted, if it is determined whether the vehicle is in an idling state based on the throttle opening degree only, differences among a plurality of the physical quantities may be adjusted under the condition where one physical quantity indicates that the vehicle is in an idling state, but another physical quantity indicates that the vehicle is not in the idling state.

SUMMARY OF THE INVENTION

The present invention provides a vehicular control apparatus and method that can accurately and properly determine whether the vehicle is in an idling state in a vehicle in which the driving force control is performed.

A vehicular control apparatus according to a first aspect of the present invention controls a device mounted on a vehicle. The control apparatus includes: a generating means for generating respective required values of the device based on quantities of state in different units; an adjusting means for converting the required values into values in one unit and obtaining a desired value of the device based on the values in one unit; a control means for controlling the device based on the obtained, desired value; and a determining means for determining whether the vehicle is in a certain state using respective reference values set for the quantities of state, the required values, and the desired value. In the control apparatus, one of the reference values is converted into the remaining reference values in different units.

According to the first aspect, the driving force control is performed with, for example, the accelerator pedal operation amount as the quantity of state, the driving force as the required value, and the engine torque as the desired value, and the adjustment is made in one unit. Note that, the operation amount in this case corresponds to the throttle opening degree. When the driving force control is performed as described above, the determination as to whether the vehicle is in a certain state (e.g. idling state) is independently made using a reference value set corresponding to the quantity of state, using a reference value set corresponding to the required value, and using a reference value set corresponding to the desired value. In this case, the reference values correspond to the certain state of the vehicle, and, for example, the reference values are the quantity of state, the required value, and the desired value indicating that the vehicle is in an idling state. Therefore, if the idling state determination is made based on any of the quantity of state, the required value, and the desired value, the determination gives the same result unless the driving force control, such as the cruise control, is performed. As a result, it is possible to provide a vehicular control apparatus that can accurately determine the state of the vehicle (e.g. whether the vehicle is in an idling state) in the vehicle in which the driving force control is performed.

A vehicular control apparatus according to a second aspect of the present invention is similar to that according to the first aspect, except that the device is an engine, and the certain state is an idling state.

According to the second aspect, when the driving force control is performed, it is accurately and properly determined whether the vehicle is in an idling state using any of the quantity of state, the required value, and the desired value.

A vehicular control apparatus according to a third aspect of the present invention is similar to that according to the second aspect, except that the reference values are values obtained through conversion performed so that the obtained values correspond to the idling state.

According to the third aspect, the reference values used for determining whether the vehicle is in an idling state are the values calculated by converting the reference values corresponding to the quantity of state, the required value, and the desired value into the values that correspond to the idling state. Therefore, when the driving force control is performed, it is accurately and properly determined whether the vehicle is in an idling state using any of the quantity of state, the required value, and the desired value.

A vehicular control apparatus according to a fourth aspect of the present invention is similar to those according to the first to third aspects, except that the quantity of state given as a result of operation performed by a driver of the vehicle brings about the certain state.

According to the fourth aspect, when the driver of the vehicle does not depress the accelerator pedal at all, the idling state of the vehicle is brought about. Such an idling state can be accurately and properly determined using any of the quantity of state, the required value, and the desired value.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIG. 2 is an operation table of an automatic transmission as shown in FIG. 1.

DETAILED DESCRIPTION OF THE PREFERRED EMBODIMENTS

Figure 1:
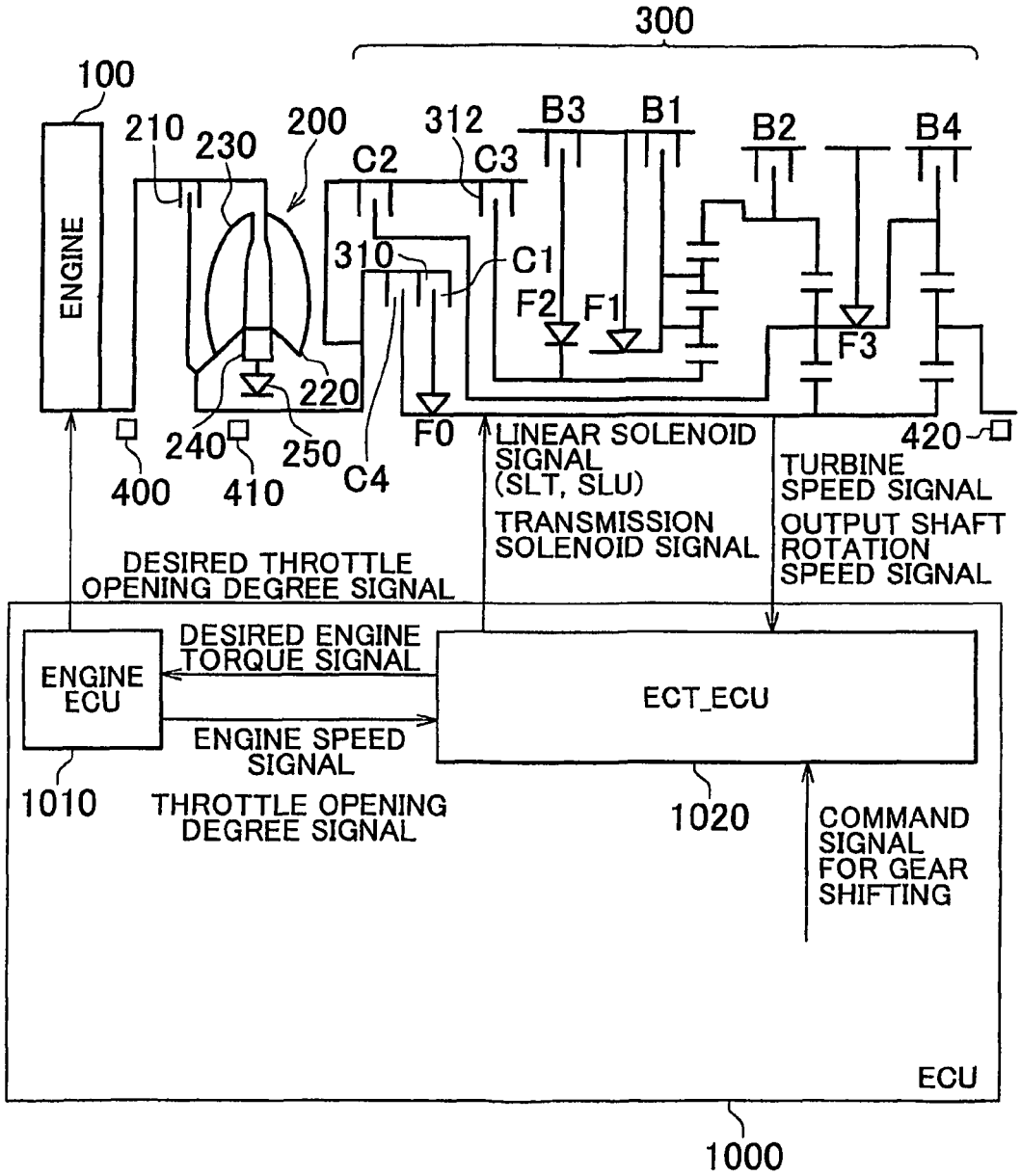
FIG. 1 is a control block diagram of a vehicle according to an embodiment of the invention.

An embodiment of the present invention will be described below with reference to the attached drawings. In the description below, the same components are denoted by the same reference numeral, and the components denoted by the same reference numeral have the same name and function. Therefore, the description thereof will not be repeated.

First, a power train of a vehicle including a vehicular control apparatus according to this embodiment will be described. The vehicular control apparatus according to the embodiment is realized by an electronic control unit (ECU) 1000 as shown in FIG. 1. In the description of the embodiment, an automatic transmission is provided with a torque converter and a planetary gear speed reduction mechanism. Further, in the embodiment, the vehicle that is provided with an engine as a power source for driving the vehicle will be described.

As shown in FIG. 1, the power train of the vehicle includes the engine 100, the torque converter 200, the automatic transmission 300, and the ECU 1000. An output shaft of the engine 100 is connected with an input shaft of the torque converter 200. The engine 100 and the torque converter 200 are connected to each other through a rotary shaft. Thus, a rotation speed NE of the output shaft of the engine 100 (engine speed NE) detected by an engine speed sensor 400 is equal to a rotation speed of the input shaft of the torque converter 200 (pump rotation speed).

The torque converter 200 includes a lockup clutch 210, a pump impeller 220, a turbine runner 230, a one-way clutch 250, and a stator 240. The lockup clutch 210 allows the input shaft and the output shaft to be directly coupled. The pump impeller 220 is arranged in the input shaft side, and the turbine runner 230 is arranged in the output shaft side. The stator 240 functions as a torque amplifier. The torque converter 200 and the automatic transmission 300 are connected to each other by a rotary shaft. A rotation speed NT of the output shaft of the torque converter 200 is detected by a turbine speed sensor 410. Note that, the rotation speed NT of the output shaft of the torque converter 200 may also be referred to as a turbine speed NT, which is equal to a rotation speed NIN of the input shaft of the automatic transmission 300. A rotation speed NOUT of the output shaft of the automatic transmission 300 is detected by an output shaft rotation speed sensor 420.

FIG. 2 is a table showing how the automatic transmission 300 operates. The table in FIG. 2 shows which clutch elements (C1 to C4 in FIG. 1), which brake elements (B1 to B4), and which one-way clutch elements (F0 to F3) are engaged or released in each gear. For example, in the first gear selected when the vehicle pulls away, the clutch element C1 and the one-way clutch elements F0, F3 are engaged.

The ECU 1000 that controls the aforementioned power train includes an engine ECU 1010 and an electronic controlled automatic transmission (ECT)_ECU 1020. The ECU 1010 controls the engine 100, and the ECT_ECU 1020 controls the automatic transmission 300.

A signal indicative of the turbine speed NT is input from the turbine speed sensor 410 to the ECT_ECU 1020, and a signal indicative of the output shaft rotation speed NOUT is input from the output shaft rotation speed sensor 420 to the ECT_ECU 1020. Further, a signal indicative of the engine speed NE detected by the engine speed sensor 400, and a signal indicative of a throttle opening degree detected by the throttle position sensor are input from the engine ECU 1010 to the ECT_ECU 1020.

These rotation speed sensors are arranged to face the teeth of the respective gears for detecting rotation, which are fixed to the input shaft and the output shaft of the torque converter 200 and the output shaft of the automatic transmission 300, respectively. These rotation speed sensors can detect slight rotation of the input shaft and the output shaft of the torque converter 200 and the output shaft of the automatic transmission 300, respectively. As the rotation speed sensors, the sensors employing, for example, a magnetic resistance element, may be used, which are generally referred to as the "semiconductor sensors".

The ECT_ECU 1020 outputs signals for controlling solenoids to linear solenoids of the automatic transmission 300. The clutch elements (C1 to C4), the brake elements (B1 to B4), and the one-way clutch elements (F0 to F3) listed in FIG. 2 are engaged or released according to the signals. For example, when the transmission shifts down from 6th gear to 5th gear, the engaging pressure of the clutch element C3 is controlled so that the clutch element C3 in the released state is engaged, and the engaging pressure of the brake element B2 is controlled so that the brake element B2 in the engaged state is released. Actually, the ECT_ECU 1020 outputs the solenoid control signals to the linear solenoid valves of the hydraulic circuit. The ECT_ECU 1020 calculates desired hydraulic pressures (the hydraulic pressures that produce the desired engaging pressures) described below. The ECT_ECU 1020 then calculates the hydraulic pressures to be supplied to hydraulic servos based on the calculated, desired hydraulic pressures and other values, and the calculated hydraulic pressures for the hydraulic servos are output to the solenoid valves.

The hydraulic circuit includes, for example, two linear solenoid valves and a plurality of the hydraulic servos, each of which engages and releases the corresponding one of a plurality of the friction elements (clutches and brakes) that change the power transmission path of the planetary gear unit of the automatic transmission to shift the transmission among six forward gears and one reverse gear. Solenoid modulator pressure is supplied to input ports of the linear solenoid valves, and the hydraulic pressure supplied from output ports of the linear solenoid valves is supplied to hydraulic fluid chambers of pressure control valves. Line pressure is input to input ports of the pressure control valves, and the pressure regulated using the control hydraulic pressure is supplied from output ports of the pressure control valves to the hydraulic servos through shift valves as needed.

The aforementioned hydraulic circuit is just an example, and in actual cases, a large number of hydraulic servos are provided corresponding to the number of the friction elements of the automatic transmission, and a large number of shift valves that change the hydraulic paths to the hydraulic servos are also provided. Further, each of the hydraulic servos includes a piston that is fitted in the cylinder in an oil tight manner using an oil seal. The piston is moved against a return spring by the regulated hydraulic pressure, supplied from the pressure control valve, that acts on a hydraulic pressure chamber, which brings an outer friction plate into contact with an inner friction member. The friction plate and the friction member of the brakes are the same as those of the clutches in structure.

The ECT_ECU 1020 detects the condition of gear shifting performed based on a command signal for gear shifting, and then sends a desired engine torque signal to the engine ECU 1010. The engine ECU 1010 calculates a desired throttle opening degree based on the desired engine torque signal so that the engine 100 produces the desired torque. Then, the engine ECU 1010 outputs a signal indicative of the desired throttle opening degree to actuators (e.g. stepping motors) of the throttle valves of the engine 100.

Figure 3:
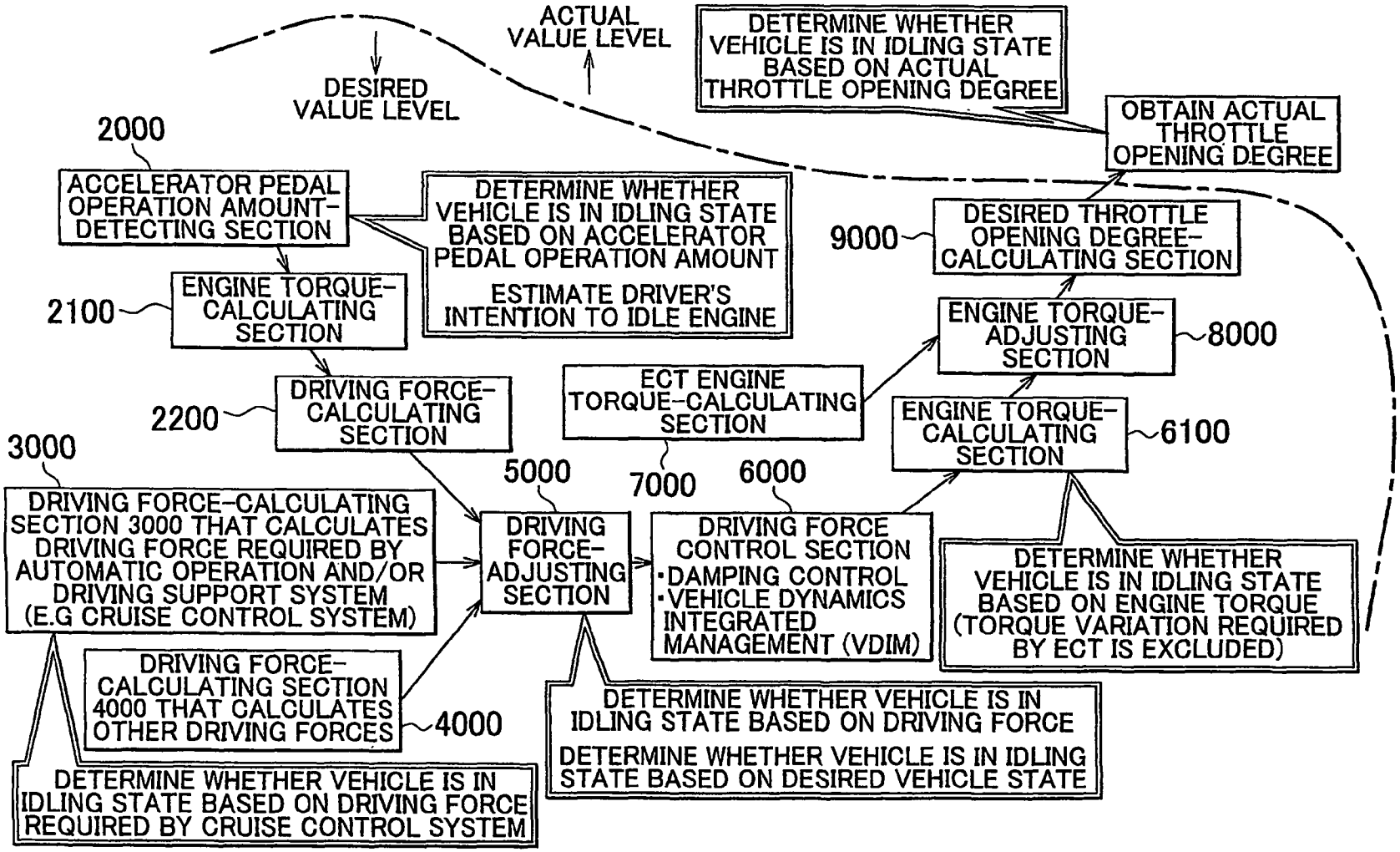
FIG. 3 is a control block diagram of the routine to calculate a desired throttle opening degree, which is performed by an ECU.

Referring to FIG. 3, the process routine for calculating the desired throttle opening degree will be described. This process routine is performed by the ECU 1000, which serves as the vehicular control apparatus according to the embodiment. Note that the process blocks at the desired value level shown in FIG. 3 are realized by programs executed by the ECU 1000, that is, by the engine ECU 1010 or the ECT_ECU 1020.

An accelerator pedal operation amount-detecting section 2000 detects the operation amount of the accelerator pedal operated by a driver. Then, it is determined whether the vehicle is in an idling state based on the detected accelerator pedal operation amount. In this case, whether the vehicle is in an idling state is determined based on the driver's intention to idle the engine. If the accelerator pedal operation amount is equal to or below a first threshold, it is determined that the driver is requiring the vehicle to idle. That is, in this case, whether the vehicle is in an idling state is determined based on the accelerator pedal operation amount and the first threshold thereof.

An engine torque-calculating section 2100 calculates an engine torque based on the accelerator pedal operation amount detected by the accelerator pedal operation amount-detecting section 2000, using a predetermined map or the like.

A driving force-calculating section 2200 calculates the driving force based on the engine torque calculated by the engine torque-calculating section 2100, using a predetermined conversion formula or the like.

Similarly, the driving force(s) required by the automatic driving system and/or the driving support system, and the driving force(s) required by other systems are calculated by the driving force-calculating sections 3000 and 4000, respectively. Then, the determination as to whether the vehicle is in an idling state is independently made based on each calculated driving force. For example, the driving force(s) required by the automatic driving system and/or the driving support system are subjected to the determination using the second threshold. Because the first and second thresholds are the physical quantities that have been subjected to the unit conversion to unify the units thereof, if the driving force(s) required by the automatic driving system and/or the driving support system are equal to or below the second threshold, it is determined that the driver is requiring the vehicle to idle.

A driving force-adjusting section 5000 adjusts differences among the driving force calculated by a driving force-calculating section 2200 based on the detected accelerator pedal operation amount, the driving force calculated by a driving force-calculating section 3000 that calculates the driving force required by the automatic driving system and/or the driving support system (e.g. cruise control system), and the driving force that is calculated by a driving force-calculating section 4000 that calculates other driving forces than the aforementioned driving forces. The adjustment is performed by selecting the smallest driving force among these driving forces, for example. Then, it is determined whether the vehicle is in an idling state based on the driving force obtained after the adjustment. If the driving force is equal to or below a third threshold, it is determined that the driver is requiring the vehicle to idle. That is, in this case, whether the vehicle is in an idling state is determined based on the driving force and the third threshold thereof. Note that, the phrase "determine whether the vehicle is in an idling state based on the desired vehicle state" in FIG. 3 indicates, for example, the case where it is determined that the vehicle is in an idling state when the cruise control system makes a determination for deceleration.

A driving force control section 6000 corrects the driving force obtained after the adjustment performed by the driving force-adjusting section 5000. The driving force control section 6000 corrects the driving force obtained after the adjustment by adding or subtracting the driving force used for the damping control of the vehicle and/or the vehicle dynamics integrated management (VDIM) to or from the driving force obtained after the adjustment.

An engine torque-calculating section 6100 calculates the engine torque based on the driving force corrected by the driving force control section 6000, using a predetermined map or the like. Then, it is determined whether the vehicle is in an idling state based on the calculated engine torque. If the engine torque is equal to or below a fourth threshold, it is determined that the driver is requiring the vehicle to idle. That is, in this case, whether the vehicle is in an idling state is determined based on the engine torque and the fourth threshold thereof. However, note that the factors related to the torque variation required by the ECT are not taken into consideration when it is determined whether the vehicle is in an idling state using the engine torque.

An engine torque-adjusting section 8000 adjusts differences among the engine torque calculated by the engine torque-calculating section 6100 based on the corrected driving force and the engine torque calculated by an ECT engine torque-calculating section 7000. The ECT engine torque-calculating section 7000 calculates the engine torque so that, for example, the engine torque is reduced during the shift control in order to improve the shift feeling and durability of the friction elements.

A desired throttle opening degree-calculating section 9000 calculates a desired throttle opening degree based on the engine torque obtained after the adjustment. A signal indicative of the desired throttle opening degree is supplied to the actuators (e.g. stepping motors) of the throttle valves of the engine 100. The actuators open the throttle valves according to the desired throttle opening degree signal, and then it is determined whether the vehicle is in an idling state based on the actual throttle opening degree, which is the throttle opening degree detected by the throttle opening degree sensor. If the actual throttle opening degree is equal to or below a fifth threshold, it is determined that the driver is requiring the vehicle to idle. That is, in this case, whether the vehicle is in an idling state is determined based on the actual throttle opening degree and the fifth threshold thereof.

In this way, as shown in the double line boxes in FIG. 3, the ECU 1000, which corresponds to the vehicular control apparatus according to the embodiment, makes determinations in the following manners:

1) in the accelerator pedal operation amount-detecting section 2000, it is determined whether the vehicle is in an idling state based on the accelerator pedal operation amount and the first threshold thereof;
2) in the driving force calculating section 3000 that calculates the driving force required by the automatic driving system and/or the driving support system, it is determined whether the vehicle is in an idling state based on the calculated driving force and the second threshold thereof;
3) in the driving force-adjusting section 5000, it is determined whether the vehicle is in an idling state based on the driving force and the third threshold thereof;
4) in the engine torque-calculating section 6100, it is determined whether the vehicle is in an idling state based on the engine torque and the fourth threshold thereof; and
5) the actual throttle opening degree is detected, and it is then determined whether the vehicle is in an idling state based on the actual throttle opening degree and the fifth threshold thereof.

In summary, the determination as to whether the vehicle is in an idling state is independently made based on the first threshold, the second threshold, the third threshold, the fourth threshold, and the fifth threshold, which are set corresponding to a minimum set of four physical quantities, the accelerator pedal operation amount, the driving force, the engine torque, and the actual throttle opening degree. Note that, the first threshold corresponds to the accelerator pedal operation amount, the second and third thresholds correspond to the driving force, the fourth threshold corresponds to the engine torque, and the fifth threshold corresponds to the actual throttle opening degree.

The five thresholds are set for four different physical quantities. Therefore, for example, the first, second, third, and fifth thresholds are calculated by converting the fourth threshold as a reference into values that correspond to the respective physical quantities.

Thus, in the driving force control that uses various types of the physical quantities as the parameters for performing the above determination, it is possible to more accurately determine whether the vehicle is in an idling state, as compared to the conventional case where only the comparison between the actual throttle opening degree and the predetermined throttle opening degree indicating that the vehicle is in an idling state is made to determine whether the vehicle is in an idling state.

Moreover, in this way, if it is determined that the vehicle is in an idling state using the physical quantities other than the actual throttle opening degree, the determination that is made using the actual throttle opening degree will also result in the determination that the vehicle is in an idling state unless the driving force control, such as the cruise control, is performed. In other words, it is guaranteed that the actual throttle opening degree indicates that the vehicle is in an idling state when it is determined that the vehicle is in an idling state using the physical quantities other than the actual throttle opening degree.

The embodiment described herein is merely an example in all respects, and it should be understood that the embodiment is not limiting. The scope of the present invention is defined not by the above description but by the scope of the claims. It is intended to include all changes and modifications within the scope of the claims and the equivalents thereof.

What is claimed is:

1. A vehicular control apparatus that controls an engine mounted on a vehicle, comprising:

a generating section that generates respective required values of the engine based on quantities of state in different units of measure;

an adjusting section that converts the required values into values in a common unit of measure and obtains a desired value of the engine based on the values in the common unit of measure;

a control section that controls the engine based on the obtained desired value; and a determining section that determines whether the vehicle is in an idling state using respective reference values set for the quantities of state, the required values, and the desired value, wherein one of the reference values is converted into the remaining reference values in different units of measure.

2. The vehicular control apparatus according to claim 1, wherein the reference values are values obtained through conversion performed so that the obtained values correspond to the idling state.

3. The vehicular control apparatus according to claim 1, wherein the quantity of state given as a result of operation performed by a driver of the vehicle brings about said idling state.

4. The vehicular control apparatus according to claim 1, wherein the reference value for the quantities of state includes a first threshold value for an operation amount of an accelerator pedal, the reference value for the required value includes a second threshold value for a driving force, and the reference value for the desired value includes a third threshold value for an engine torque and a fourth threshold value for an actual throttle opening degree.

5. The vehicular control apparatus according to claim 4, wherein the fourth threshold value is converted into the first threshold value, the second threshold value and the third threshold value; and the determining section determines whether the vehicle is in the idling state using at least one of the first threshold value, the second threshold value, third threshold value and fourth threshold value.

6. A method of controlling an engine mounted on a vehicle, comprising:

generating respective required values of the engine based on quantities of state in different units of measure;

converting the required values into values in a common unit of measure and obtaining a desired value of the engine based on the values in the common unit of measure;

controlling the engine based on the obtained desired value; and determining whether the vehicle is in an idling state using respective reference values set for the quantities of state, the required values, and the desired value, wherein one of the reference values is converted into the remaining reference values in different units of measure.

7. A vehicular control apparatus that controls an engine mounted on a vehicle, comprising:

means for generating a plurality of required values of the engine based on a plurality of quantities of state that are different from each other so that the plurality of required values corresponds to the plurality of quantities of state, respectively;

means for adjusting the plurality of required values so as to calculate an integrated required value;

means for calculating a desired value of the engine based on the integrated required value;

means for controlling an operation amount of a component that controls the engine based on the calculated desired value;

first means for determining whether the vehicle is in an idling state using any one of the plurality of quantities of state and a first threshold set for the any one of the plurality of quantities of state;

second means for determining whether the vehicle is in the idling state using the integrated required value and a second threshold set for the integrated required value; and third means for determining whether the vehicle is in the idling state using the desired value and a third threshold set for the desired value, wherein a fourth threshold for determining whether the vehicle is in the idling state based on the operation amount of the component is set to a reference value, and the first threshold, the second threshold, and the third threshold are values obtained through conversion performed so that the reference value corresponds to any one of the plurality of quantities of state, the integrated required value, and the desired value.

* * * * *